United States Patent [19]

Basnett et al.

[11] Patent Number: 4,559,511

[45] Date of Patent: Dec. 17, 1985

[54] VACUUM CONTACTOR HAVING DC ELECTROMAGNET WITH IMPROVED FORCE WATTS RATIO

[75] Inventors: Robert T. Basnett, Hendersonville, N.C.; Walter V. Bratkowski, McKeesport, Pa.

[73] Assignee: Westinghouse Electric Corp., Pittsburgh, Pa.

[21] Appl. No.: 486,584

[22] Filed: Apr. 19, 1983

[51] Int. Cl.[4] ..... H01H 51/08

[52] U.S. Cl. ..... 335/132; 335/281; 200/144 B; 336/212

[58] Field of Search ..... 335/151, 152, 153, 154, 335/132, 180, 245, 246, 281, 297, 261; 200/144 B; 336/219, 212, 210, 178

[56] References Cited

U.S. PATENT DOCUMENTS

| | | | |
|---|---|---|---|
| 3,188,427 | 6/1965 | Cooper et al. | 335/281 |
| 3,330,994 | 7/1967 | Kissy | 335/180 |
| 3,553,617 | 1/1971 | Turnbull et al. | 335/202 |
| 4,223,289 | 9/1980 | Immel | 335/202 |

*Primary Examiner*—E. A. Goldberg
*Assistant Examiner*—George Andrews
*Attorney, Agent, or Firm*—John Victor Pezdek

[57] ABSTRACT

A vacuum contactor having a compact DC electromagnet with an improved force watts ratio. The DC electromagnet consisting of a dual pickup coil and holding coil winding assembly and a solid U-shaped core having removable legs secured to a base with an adhesive backed aluminum shim positioned intermediate the legs and base, the ampere turns of the pickup coil being approximately 7.5 times those of the holding coil with the legs of the core being approximately ⅓ the length of those in a conventional DC electromagnet having substantially the same force watts ratio. The shorter legs of the core reduce magnetic losses and provide increased magnetic coupling with the moving armature of the contactor closing mechanism. This allows the smaller magnet to exert a greater force upon the armature during closing of the vacuum interrupter. With decreased magnetic losses, the size of the windings can be reduced, facilitating removal of the heat generated therein and producing a small, efficient magnet.

11 Claims, 8 Drawing Figures

VACUUM CONTACTOR HAVING DC ELECTROMAGNET WITH IMPROVED FORCE WATTS RATIO

CROSS-REFERENCE TO RELATED APPLICATIONS

The material presented herein is related the material presented in the following copending patent applications: Ser. No. 486,588, filed Apr. 19, 1983, entitled "Mechanical Interlock Mechanism For A Vacuum Contactor;" Ser. No. 486,590, filed Apr. 19, 1983, entitled "Vacuum Contactor Kickout Spring Adjustment Apparatus;" Ser. No. 486,589, filed Apr. 19, 1983, entitled "Contact Overtravel Adjustment Apparatus for a Vacuum Contactor."

BACKGROUND OF THE INVENTION

1. Field of the Invention

In general, the invention relates to vacuum contactors employing interrupters and in particular to DC electromagnets utilized to close the vacuum contactor.

2. Description of the Prior Art

There are many designs of vacuum interrupters in existence. U.S. Pat. No. 4,002,867, issued Jan. 11, 1977 entitled "Vacuum Type Circuit Interrupters With a Condensing Shield at a Fixed Potential Relative to the Contact" is a representative example of such vacuum interrupters. An operating mechanism combined with one, two or three vacuum interrupters constitutes a vacuum contactor. In contradistinction to circuit breakers which are considered as principal protective devices during fault conditions in an electrical circuit and are designed for 20,000 to 50,000 operations, the vacuum contactor is used to start and stop various electric loads in response to signals generated by control devices such as push button switches, limit switches, and programmable controllers with the vacuum contactor being designed to have a lifetime of 2 to 3 million operations.

The main difference between vacuum contactors and conventional air break contactors is that the vacuum interrupters of the vacuum contactor break or interrupt the electric current inside a vacuum chamber instead of inside an air arc box. The vacuum chamber for the vacuum interrupter consists of a unit assembly of a sealed evacuated enclosure surrounding a fixed or stationary electrical contact and a moveable electrical contact. A portion of the moveable contact extends through a gas-tight metallic bellows which allows for the essentially linear motion of the moveable contact with respect to the stationary contact. The bellows is attached to the evacuated chamber by means of an end seal. Another end seal is provided for attaching the stationary contact to the enclosure. The ceramic sleeve or cylinder is provided to separate and electrically update the two contacts. The end seals are attached to the ends of the ceramic sleeve forming the evacuated chamber of the vacuum interrupter.

Because vacuum interrupters are normally closed by atmospheric pressure and an auxiliary contact spring, means must be provided to force the contacts into the open position which is the normal state for a deenergized contactor. The actual contact force holding the moveable and stationary contacts together inside each vacuum interrupter is the sum of the atmospheric force (atmospheric pressure times the mean area of the bellows) plus the force provided by the auxiliary contact spring and the mechanical spring force exerted by the bellows. This auxiliary contact spring force increases the total force sufficiently to sustain closure of the contacts during high short circuit currents that tend to blow the contacts apart. In the deenergized condition, there is no electrical energy available to provide the force necessary to separate the contacts. Instead, one or more mechanical springs provide this contact opening force. In practice this spring, called the kickout spring, exerts sufficient force to maintain the contacts in the open position in a deenergized contactor. To close the contacts of the vacuum interrupter on command, an electromagnet is provided that when energized, will pull the operating mechanism closed, overcoming the force of the kickout spring and closing the contacts of the vacuum interrupter.

It has generally been known that it should be possible to make DC excited electromagnets smaller that AC excited magnets for a given tractive pull. Since electromagnets are used by the thousands in industry, their optimization is a matter of importance. However, the potential capability of DC electromagnets has not been attained in the past; in fact, their capability has been less than AC versions of the same physical size.

An evaluation of electromagnets compares the magnetic force (pull) per watt of electrical energy consumed, all other parameters being equal. The electrical energy is consumed in the production of magnetic flux across the airgap of the electromagnet, which flux requires excitation of the magnet by a magnetomotive force expressed in ampere turns, i.e., current through the magnet coil times the number of turns in the magnet coil.

In an alternating current (AC) magnet the flux across the airgap alternates, producing a net magnetic force whose value cyclically varies at twice line frequency, producing chattering and not much effective force. Therefore, short circuited loops called shading coils are embedded in a portion of each magnet face to force the airgap flux into two time-phased components that do not go to zero simultaneously and therefore create a quiet, almost steady net pull. In such Ac magnets there are four consumers of energy:

(1) The $I^2R$ losses in the operating coil, where I is the coil current and R the coil DC resistance.

(2) The $NI_s^2R_s$ shading losses, where $I_s$ is the current in the shading coils, $R_s$ is the shading coil resistance, and N is the number of shaders, usually two.

(3) Eddy current core losses in the magnet iron due to induced currents in the laminations, rivets, and other magnetic loops.

(4) Hysteresis core losses in the magnet iron due to cyclical reversal of the flux. This is a function of the basic raw material, its thickness, and its heat treatment.

The above is not intended to be an exact description of a shaded AC magnet, but instead is a statement of the various types of losses involved in an AC magnet. As will be described hereinafter, only $I^2R$ losses, Item 1, occur in a DC magnet.

With regard to item 2, shading losses, it is not practical to reduce them to zero, since the time displacement between the two flux components would also reduce to zero, and the magnet would become both noisy and weak. A trade-off must be made in shaded area of magnet face, shading coil impedance, and shading watts for acceptable magnet noise and pull.

There is a compensating advantage for all these losses. When the AC magnet is at open gap, its coil impedance is low, the operating coil current is high, and the ampere turn excitation is high at a time when high excitation is desirable for pick-up. The operating coil current for an AC magnet is closed, the impedance increases, the exciting current decreases, and watts loss decreases acceptably.

In a direct current (DC) magnet the flux across the airgap does not alternate, no shading coils are required, and the magnet need not be laminated to reduce core losses (which do not exist on DC). The current in the operating coil is limited only by the DC resistance of the coil and is therefore independent of the magnet gap. The core of the DC magnet can be laminated to reduce eddy currents. However, lack of eddy currents reduces magnetic damping of the closing mechanism to a minimum inducing mechanical transients, i.e., vibration, upon closing of the vacuum contactor. This causes chattering of the closing mechanism that adversely effects the performance of the vacuum contactor.

Stated slightly differently, the ampere turns available for pick-up on open gap (i.e., the vacuum contactor is open) on a DC magnet is the same as the ampere turns on closed gap (i.e., the vacuum contactor is closed). Because more ampere turns are required to establish the flux across an open gap than a closed gap, the designer must choose between making an inefficient DC magnet whose closed gap pull is more than required (in order to obtain the open gap pull needed), or increasing the closed gap resistance of the coil circuit to mimic the automatic impedance change of an AC magnet. This has been done in the past by inserting resistance into the coil current by means of an auxiliary contact as the magnet closed. In more recent times an improved arrangement using a two winding coil and integral rectifier has been developed. For an example refer to U.S. Pat. No. 4,223,289, entitled "AC-DC Magnet Coil Assembly For Low Dropout AC Contactors," issued Sept. 16, 1980 and assigned to the assignee of the present invention.

The cost of energy to operate a magnet is generally not a key reason for concern with the watts loss. Rather, the concern is that the watts loss is dissipated as heat, with the maximum temperature limited by the insulation of the magnet wire and the material of the coil spool. The heat generated in a coil must be transferred to the magnet core or to the coil surface and from there into the air. For a given ampere turns, a long coil of small diameter would promote heat transfer, but as the length of the coil is increased, the length of the magnet core must of necessity increase. As the magnet core increases in length, more and more magnetic flux linkages do not cross the airgap to the moving armature, and therefore do not contribute to the pulling force. If carried to extreme, such a long magnet core becomes a reactor or choke rather than a tractive magnet. Therefore, a more compact DC electromagnet having a lower watts loss while maintaining pulling forces equivalent to conventional DC electromagnets presently used would be beneficial.

SUMMARY OF THE INVENTION

In general, the invention relates to a vacuum contactor utilizing a DC magnet that has an improved force watts ratio. The vacuum contactor comprises one or more vacuum interrupters for opening and closing an electrical circuit and an operating mechanism for effecting the opening and closing of the vacuum interrupter. The operating mechanism includes a kickout spring for opening the vacuum interrupter and a DC electromagnet for closing the vacuum interrupter in response to a control signal. Each vacuum interrupter has a stationary contact and a moveable contact enclosed in an evacuated chamber having a substantially gas-tight opening through which a portion of the moveable contact extends. A linkage to this extension of the moveable contact of the vacuum interrupter is provided to transfer the opening and closing forces of the kickout spring and DC electromagnet, respectively, to the vacuum interrupter. A member of this linkage termed a leg is acted upon by the kickout spring during opening and also serves as magnetically permeable moveable armature for the DC electromagnet. The leg or armature is spaced from the electromagnet when the vacuum contactor is open.

Included in the DC electromagnet are a solid, magnetically permeable U-shaped core having a base and a pair of legs separably attached thereto, fastening means for attaching the legs to the base, and a nonmagnetic, adhesive backed shim positioned intermediate the base and the legs with the shim adhering to the base. A multiturn holding coil and a multiturn pickup coil are also provided and positioned about the legs of the core. The holding coil and pickup coil are electrically connected to a source of DC potential with the ampere turns of the pickup coil being 7.5 times that of the holding coil.

The holding coil, pickup coil, armature, and core cooperate in the following manner:

(a) when the interrupter is open upon energization of the pickup coil magnetization of the core occurs creating a magnetic field of sufficient attracting force crossing the gap to the armature and moving the armature into contact with the legs of the core, the movement of the armature closing the vacuum interrupter;

(b) when the vacuum interrupter is closed the holding coil is energized and magnetizes the core and armature with a magnetic field having sufficient force to hold the armature in contact with the core keeping the interrupter closed; and (c) upon reopening of the interrupter the holding coil and the pickup coil are deenergized with the shim in the core acting to reduce the residual magnetic attraction between the armature and the core thereby reducing the amount of the force required for reopening.

The legs of the core are approximately $\frac{1}{3}$ the length of those in a conventional DC electromagnet having substantially the same force to exciting watts ratio. The shorter legs of the core reduce magnetic losses and provide increased magnetic coupling with the moving armature. This allows the smaller magnet to exert a greater force upon the armature during closing of the vacuum interrupter. With decreased magnetic losses, the size of the windings can be reduced, facilitating removal of the heat generated therein and producing a small, efficient magnet.

BRIEF DESCRIPTION OF THE DRAWINGS

For a better understanding of the invention, reference may be made to the preferred embodiments exemplary of the invention shown in the accompanying drawings in which.

DESCRIPTION OF THE PREFERRED EMBODIMENTS

Figure 1:
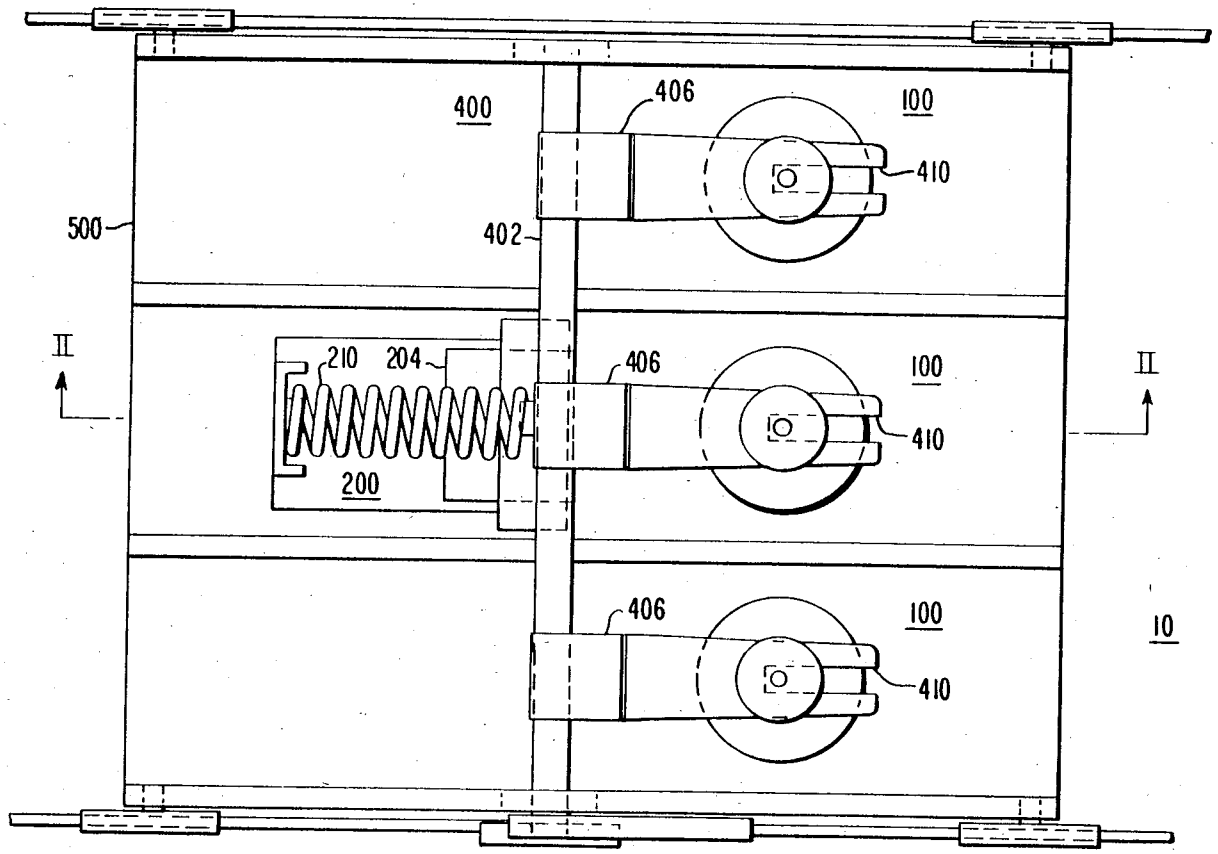
FIG. 1 is a plan view of a vacuum contactor embodying the present invention.
Figure 2:
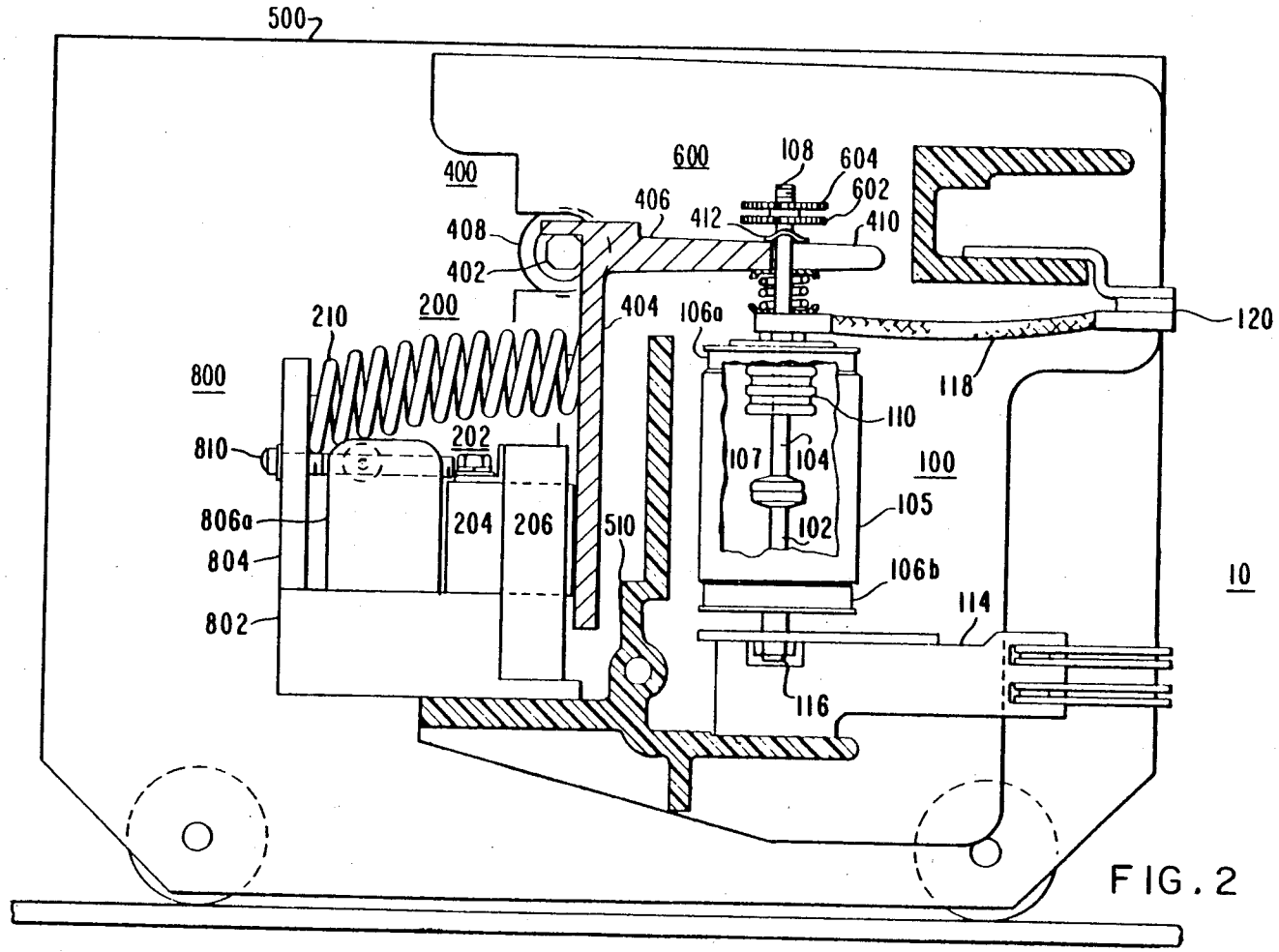
FIG. 2 is a sectional view of the vacuum contactor taken along line II—II of FIG. 1 showing the vacuum contactor in the closed position.
Figure 3:
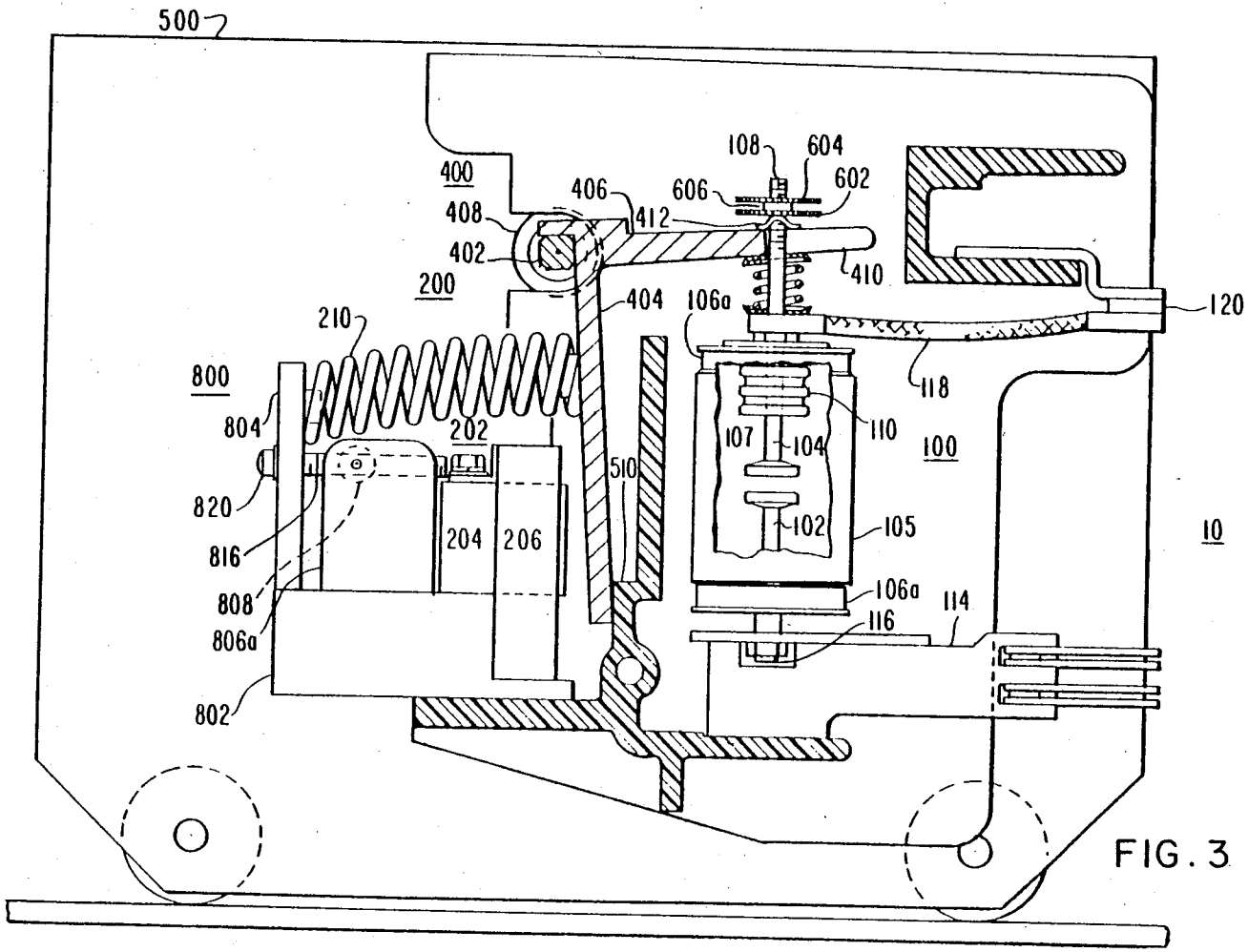
FIG. 3 is a view of the vacuum contactor of FIG. 3 showing the vacuum contactor in the open position.

Referring to FIGS. 1 through 3, a vacuum contactor 10 comprising a vacuum interrupter 100, an operating mechanism 200 for the interrupter 100 is shown. The interrupter 100 includes a stationary contact 102, a moveable contact 104, and an electrically insulating sleeve 105 and two end seals 106*a* and 106*b* forming an evacuated chamber 107 enclosing both contacts. An opening is provided in the chamber 107 through which a portion 108 of the moveable contact 104 extends. The combination of a metallic bellows 110 and the end seal 106*a* provides a gas-tight seal for the opening of the chamber 107 allowing for the linear motion of the moveable contact 104. The stationary contact 102 mounts to the sleeve 105 via the end seal 106*b* and connects to an electrically conductive bus 114 via a fastener such as the bolt 116. A flexible electrically conductive shunt 118 is provided between a second bus bar 120 and the extension 108 of the moveable contact 104 thus completing the other side of the circuit. When the contacts are closed, the electric circuit through the second bus bar 120, shunt 118, moveable contact 104, stationary contact 102, and first bus bar 114 is complete. The insulating sleeve 105, usually made of a ceramic material, is necessary in order to maintain the electrical isolation of the moveable contact 104 from the stationary contact 102 when the vacuum interrupter 100 is deenergized in that the stationary contact 102 is usually connected to the source of electrical potential.

The operating mechanism 200 includes DC electromagnet 202 that when energized closes the contacts and a kickout spring 210 that oens the contacts when the electromagnet 202 is deenergized. The electromagnet 202 is a two-piece assembly with a magnetically permeable, U-shaped core 204 and a dual winding assembly 206 having pickup coil 220 and a holding coil 222 being disposed about the legs 230 and 232, respectively, of the core 204 (see FIGS. 4 and 5). Because of space considerations, the operating mechanism 200 is not axially aligned with the moveable contact 108. Accordingly, a linkage 400 is used between the operating mechanism 200 and the moveable contact 104 to translate the opening and closing forces to the axis of movement of the moveable contact 104. The linkage 400 consists of a shaft 402 that has a radially extending leg 404 and arm 406 and is rotatably supported by means of bearings 408 provided in the housing 500. The leg 404 extends from the shaft 402 adjacent the core 204 of the electromagnet 202, the portion of the leg 404 adjacent the core 204 being magnetically permeable and forming a moveable armature for the electromagnet 202.

When the electromagnet 202 is energized in response to a control signal generated by a control device such as a pushbutton switch, the magnetic flux created exerts a pull upon the magnetically permeable portion of the leg 404 drawing the leg 404 into contact with the core 204 of the electromagnet 202, compressing the kickout spring 210, and rotating the leg 404 and shaft 402 through an arc. The arm 406 is also rotated in the same direction allowing the atmospheric force upon the bellows 110 to transfer the moveable contact 104 to the closed position (see FIG. 2). An auxiliary spring 130 can be provided intermediate the arm 406 and the chamber 106 to provide additional closing force. Because the amount of contact travel is in the range of 0.1 to 0.2 inches, the amount of rotation of the leg, shaft, and arm is in the range of 3 to 4 degrees. When the electromagnet 202 is deenergized, the kickout spring 210 acts upon the leg 404 providing sufficient force to overcome any residual magnetic attraction between the leg 404 and the electromagnet 202 rotating the leg and shaft 402 back to their original positions. This in turn rotates the 406 arm lifting the nut 602; thus, transferring the moveable contact 104 to the open position. The opening 410 in the arm 406 is made such that the moveable contact 104 follows a linear path even though, the leg 404, arm 406, and shaft 402 are rotating through arcs. This prevents lateral stresses generated by the rotation of the linkage 400 from being transmitted to the bellows 110. These lateral stresses can decrease the operating life of the bellows leading to the failure of the interrupter. In addition a stop 510 is provided on the housing 500, preferably adjacent the leg 404, to arrest the motion of the linkage 400 caused by kickout spring 210. This prevents overextension of the bellows 110 as the moveable contact 104 returns to the open position when the contactor is deenergized.

Figure 5:
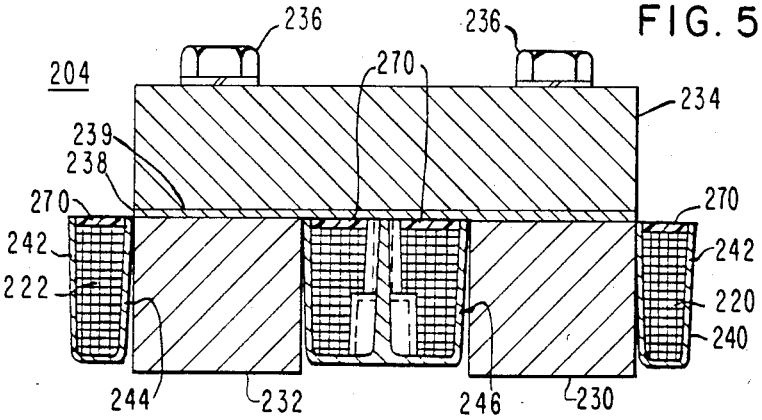
FIG. 5 is a sectional view taken along the line V—V of FIG. 4.
Figure 4:
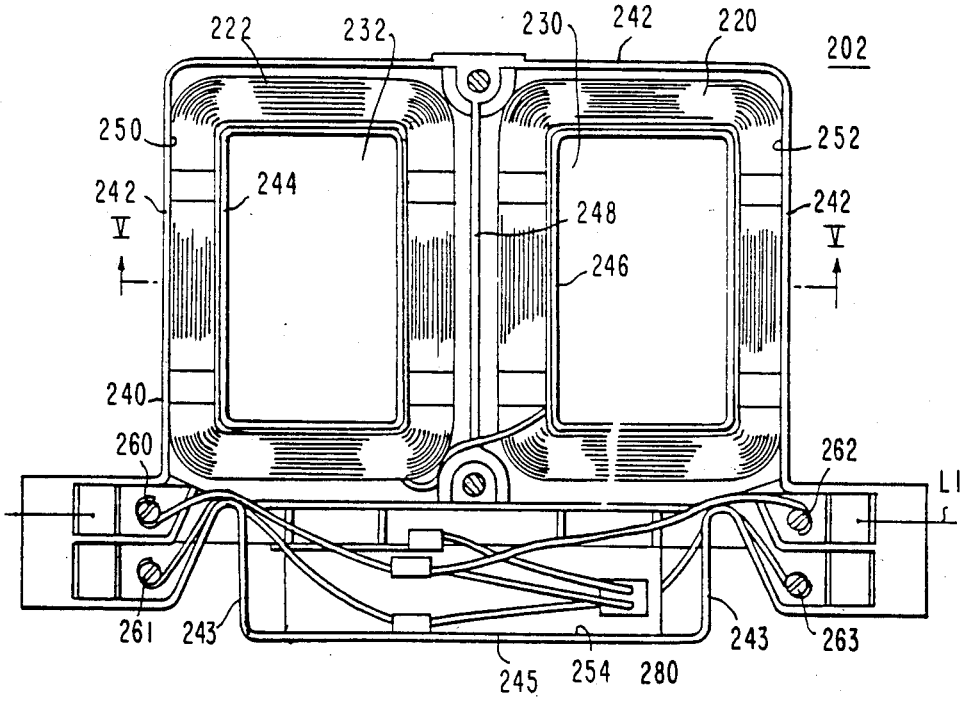
FIG. 4 is a vertical plan view of the electromagnet in accordance with this invention taken along the line IV—IV of FIG. 2.
Figure 7:
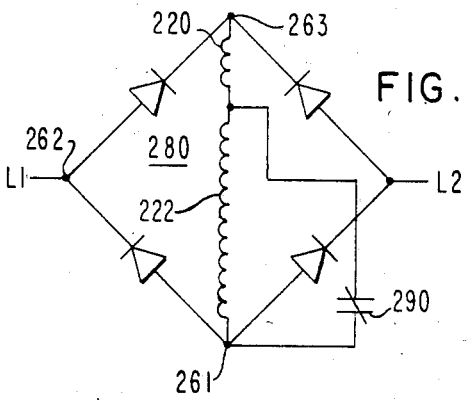
FIG. 7 is a circuit diagram showing the vacuum contactor in the open position.
Figure 8:
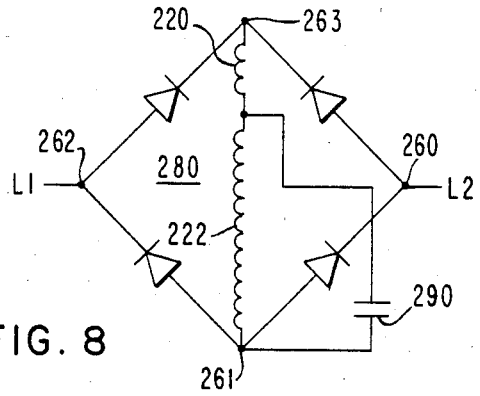
FIG. 8 is a circuit diagram showing the vacuum contactor in the closed position.

As shown more particularly in FIGS. 4 and 5 the DC electromagnet 202 comprises a molded shell 240 of dielectric insulating material, such as a thermosetting mineral-filled epoxy or glass reinforced polyester resin. The shell includes a peripheral wall 242 and a pair of inner walls 244, 246 and a divider wall 248. The inner walls 244, 246 form separate openings through which the two legs 230, 232 of the core 204 extend (FIG. 5). The inner walls 244, 246 also form with the walls 242, 248 a pair of troughs 250, 252 which are separated from each other by divider wall 248. The molded shell 240 contains the dual winding assembly 202 which comprises a holding coil 222 and a pickup coil 220. The trough 250 contains the holding coil 222 and the trough 252 contains the pickup coil 220. A recitifier 280 is interconnected with the coils 220, 222 by suitable conductor wires. In addition, conductor wire terminals 260, 261, 262, 263 are provided in a conventional manner. The circuits of FIGS. 7 and 8 show the vacuum contactor in the open and closed positions with a normally closed auxiliary contact 290 between the terminals 261 and 263.

The molded shell 240 also comprises a trough 254 provided by walls 243, 245 which are an integral part of and extend from the wall 242 (FIGS. 4, 5). A rectifier 280 can be installed in the trough 254 proximate to the coils 220, 223 and because of this proximity enables the elimination of other conductors. After the coils 220, 223 and the rectifier 280 are inserted in place as shown in FIG. 4, they are subsequently encapsulated or embedded in a layer 270 (FIG. 5) of a suitable dielectric and insulating material such as mineral-filled polyester resin.

AC line voltage, typically 110/120 volts, 50/60 Hz, is applied at L1 and L2 to the rectifier 280 to produce the DC voltage required for operation of the holding and pickup coils. Where the rectifier is not supplied, a suitable source of DC voltage is required.

The legs 230, 232 are attached to a base 234 thereto via conventional fastening means such as the bolts 236 to form the core 204. This construction of the core 204 allows an adhesive backed nonmagnetic shim 238 to be applied to a surface 239 of the base 234. The shim 238 is used to provide a gap in the core 204 which reduces the residual magnetism thereof when the coils 220 and 222 are deenergized. Preferably, the shim 238 is made of aluminum foil. The adhesive coating allows the shim 238 to be quickly attached to the base 234 during initial assembly of the core 204. The shim 204 is easily pierced by the bolts 236 when the legs 230, 232 are to be attached. Because the shim 238 is inexpensive, the entire surface 239 is covered although only the areas of the base 234 in contact with the legs 230, 232 need to be covered. Alternately, two shims can be used one adhering to the end of each leg in contact with the base.

The pickup coil 220 is constructed of 700 turns of No. 25 wire that has a resistance of approximately 16.9 ohms. The holding coiling 222 is wound from 4000 turns of No. 33 wire that has a resistance of approximately 613 ohms. This results in the pickup coil 220 have approximately 7.5 times the ampere turns of the holding coil. To close the vacuum interrupter the holding coil 222 is shorted out by the normally closed auxiliary contact 290. The low resistance of the pickup coil draws a high current creating a high magnetic pulling force of several hundreds of pounds for closing. Once closed the vacuum contactor 10 is closed the auxiliary contact 290 opens adding the holding coil 220 in series with the pickup coil 222. The higher total resistance reduces the current in the circuit to a level sufficient to produce a force of approximately 100 pounds to hold the vacuum contactor 10 closed. When the two coils are deenergized, the kickout spring 210 opens the vacuum contactor 10.

Figure 6:
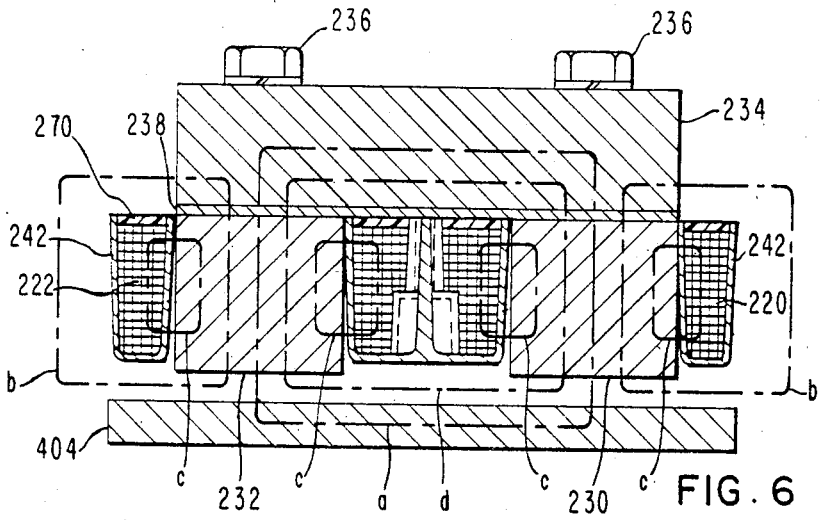
FIG. 6 is an illustration of the magnetic flux lines for the electromagnet of FIG. 5.

FIG. 6 illustrates various magnetic paths on the electromagnet 202. Only the magnetic lines leaving or entering the faces of legs 230, 232 of the core 204 are useful in attracting the leg 404. Line a is one such path. The other paths shown by lines b, c, and d are lines of magnetic flux which are not useful in producing attractive or pulling force and create watts loss and heating of the coils. The existing approach to obtain an increase in the attractive force of the magnet was to increase the size of the core by lengthening the legs, thus, allowing for more turns in the coils and a larger heat transfer area. However, as the length of the core increases, increased core losses outweighed any gain in attractive force. It was unexpectedly found that by decreasing rather than increasing the length of the legs of the core that the equivalent attractive force remained while the core losses decreased. In a DC electromagnet of the present invention the legs of the core are reduced to about ⅓ the length of those of a conventional DC electromagnet while maintaining equivalent attractive force. Because of shorter legs 230, 232 the losses represented by lines b and c are reduced over those found in a conventional magnet have longer core legs. Further, the length of the coils is reduced as compared to conventional coils further reducing losses attributable to the coils. Thus a more compact DC electromagnet is produced having a lower watts loss while maintaining pulling forces equivalent to conventional DC electromagnets presently used. Further, the DC electromagnet of the present invention is not intended for a particular style or manufacture of vacuum contactor.

I claim:

1. A vacuum contactor, comprising:

vacuum interrupter means for opening and closing an electrical circuit;

operating means for effecting the opening and closing of the vacuum interrupter means, the operating means including a DC electromagnetic closing means for closing the vacuum interrupter means in response to a control signal;

the DC electromagnetic closing means comprising:

a solid, magnetically permeable U-shaped core having a base and a pair of legs separably attached thereto;

fastening means for attaching the legs to the base;

a nonmagnetic, adhesive backed foil shim intermediate the base and the legs with the shim adhering to the base;

a magnetically permeable, moveable armature adjacent the ends of the legs of the core with the armature spaced therefrom forming a gap therebetween when the vacuum interrupter means is open;

a multiturn holding coil; and a multiturn pickup coil, the holding coil and pickup coil electrically connected to a source of DC potential with the ampere turns of the pickup coil being about 7.5 times that of the holding coil, the holding coil, pickup coil, armature, and core cooperating in the following manner:

(a) when the vacuum interrupter means is open upon energization of the pickup coil magnetization of the core occurs creating a magnetic field of sufficient attracting force crossing the gap to the armature and moving the armature into contact with the legs of the core, the movement of the armature closing the vacuum interrupter means;

(b) when the vacuum interrupter means is closed the holding coil being energized and magnetizing the core and armature with a magnetic field having sufficient force to hold the armature in contact with the core keeping the vacuum interrupter means closed; and (c) upon reopening of the vacuum interrupter means the holding coil and the pickup coil being deenergized whereby the shim in the core acts to reduce the residual magnetic attraction between the armature and the core with the legs of the core being approximately ⅓ of the length of those in a conventional DC electromagnet having substantially the same force to exciting watts ratio whereby the shorter legs of the core reduce magnetic losses therein allowing a greater force to be exerted upon the armature during closing of the vacuum interrupter means.

2. The apparatus of claim 1 wherein the pickup coil is disposed about one leg of the core with the holding coil disposed about the other leg thereof.

3. A vacuum contactor, comprising:

vacuum interrupter means for opening and closing an electrical circuit;

operating means for effecting the opening and closing of the vacuum interrupter means, the operating means including a DC electromagnetic closing means for closing the vacuum interrupter means in response to a control signal;

the DC electromagnetic closing means comprising:

a solid, magnetically permeable U-shaped core having a base and a pair of legs separably attached thereto;

fastening means for attaching the legs to the base;

a nonmagnetic, adhesive backed foil shim intermediate the base and the legs with the shim adhering to the base, the fastening means piercing the shim;

a magnetically permeable, moveable armature adjacent the ends of the legs of the core with the armature spaced therefrom forming a gap therebetween when the vacuum interrupter means is open;

a multiturn holding coil; and a multiturn pickup coil, the holding coil and pickup coil electrically connected to a source of DC potential with the ampere turns of the pickup coil being about 7.5 times that of the holding coil, the holding coil, pickup coil, armature, and core cooperating in the following manner:

(a) when the vacuum interrupter means is open upon energization of the pickup coil magnetization of the core occurs creating a magnetic field of sufficient attracting force crossing the gap to the armature and moving the armature into contact with the legs of the core, the movement of the armature closing the vacuum interrupter means;

(b) when the vacuum interrupter means is closed the holding coil being energized and magnetizing the core and armature with a magnetic field having sufficient force to hold the armature in contact with the core keeping the vacuum interrupter means closed; and (c) upon reopening of the vacuum interrupter means the holding coil and the pickup coil being deenergized whereby the shim in the core acts to reduce the residual magnetic attraction between the armature and the core with the legs of the core being approximately $\frac{1}{3}$ the length of those in a conventional DC electromagnet having substantially the same force to exciting watts ratio whereby the shorter legs of the core reduce magnetic losses therein allowing a greater force to be exerted upon the armature during closing of the vacuum interrupter means.

4. The apparatus of claim 3 wherein the pickup coil is disposed about one leg of the core with the holding coil disposed about the other leg thereof.

5. A vacuum contactor, comprising:

vacuum interrupter means for opening and closing an electrical circuit;

operating means for effecting the opening and closing of the vacuum interrupter means, the operating means including a DC electromagnetic closing means for closing the vacuum interrupter means in response to a control signal;

the DC electromagnetic closing means comprising:

a solid, magnetically permeable U-shaped core having a base and a pair of legs separably attached thereto;

fastening means for attaching the legs to the base;

a nonmagnetic, adhesive backed foil shim intermediate the base and the legs with the shim adhering to the base, the fastening means piercing the shim;

a magnetically permeable moveable armature adjacent the ends of the legs of the core with the armature spaced therefrom forming a gap therebetween when the vacuum interrupter means is open;

a multiturn holding coil; and a multiturn pickup coil, the holding coil and pickup coil electrically connected to a source of DC potential with the ampere turns of the pickup coil being about 7.5 times that of the holding coil, the turns of the pickup coil disposed about one leg of the core with the turns the holding coil disposed about the other leg, the holding coil, pickup coil, armature, and core cooperating in the following manner:

(a) when the vacuum interrupter means is open upon energization of the pickup coil magnetization of the core occurs creating a magnetic field of sufficient attracting force crossing the gap to the armature and moving the armature into contact with the legs of the core, the movement of the armature closing the vacuum interrupter means;

(b) when the vacuum interrupter means is closed the holding coil being energized and magnetizing the core and armature with a magnetic field having sufficient force to hold the armature in contact with the core keeping the vacuum interrupter means closed; and (c) upon reopening of the vacuum interrupter means the holding coil and the pickup coil being deenergized with the shim in the core acting to reduce the residual magnetic attraction between the armature and the core, the legs of the core being approximately $\frac{1}{3}$ the length of those in a conventional DC electromagnet having substantially the same force to exciting watts ratio whereby the shorter legs of the core reduce magnetic losses therein allowing a greater force to be exerted upon the armature during closing of the vacuum interrupter means.

6. The apparatus of claim 5 wherein the shim is made of aluminum.

7. The apparatus of claim 1 wherein the shim is made of aluminum.

8. A magnetic core for a DC electromagnet for use in a vacuum contactor comprising:

a solid magnetically permeable U-shaped core having a base and a pair of legs separably attached thereto;

fastening means for attaching the legs to the base;

a non-magnetic adhesive-backed shim intermediate the base and legs with the shim adhering to the base with the fastening means piercing the shim during attachment of the legs to the base.

9. The apparatus of claim 8 wherein the shim is formed from adhesive-backed aluminum foil.

10. A DC electromagnet including a holding coil assembly, an exciting coil assembly and a U-shaped core, the core comprising:

a solid magnetically permeable U-shaped core having a base and a pair of legs separably attached thereto;

fastening means for attaching the legs to the base;

a non-magnetic adhesive-backed shim intermediate the base and legs with the shim adhering to the base with the fastening means piercing the shim during attachment of the legs to the base and the holding coil and exciting coil assemblies disposed about the legs of the U-shaped core.

11. The apparatus of claim 10 wherein the shim is formed from adhesive-backed aluminum foil.

* * * * *